United States Patent [19]

Joseph, Jr. et al.

[11] Patent Number: 4,852,510

[45] Date of Patent: Aug. 1, 1989

[54] SCUBA WHISTLE

[75] Inventors: Alan W. Joseph, Jr., 302 Washington Ave., Mount Vernon, Ind. 47620; Timothy E. Joseph, Los Angeles, Calif.

[73] Assignee: Alan W. Joseph, Jr., Mount Vernon, Ind.

[21] Appl. No.: 40,161

[22] Filed: Apr. 20, 1987

[51] Int. Cl.[4] ..... G10K 5/00

[52] U.S. Cl. ..... 116/140; 116/137 R; 367/148; 367/910

[58] Field of Search ..... 84/330; 116/137 R, 137 A, 116/139, 140, 141, DIG. 18, DIG. 19, DIG. 44, 67 R, 70; 181/120, 142; 446/216; 340/406; 367/134, 143, 910, 198, 148

[56] References Cited

U.S. PATENT DOCUMENTS

| | | | |
|---|---|---|---|
| 471,015 | 3/1892 | Nessle | 116/140 |
| 945,371 | 1/1910 | Bretonneau | 116/137 R |
| 1,530,899 | 3/1925 | Limon | 116/137 R |
| 1,540,023 | 6/1925 | Kollinek | 116/137 R |
| 1,595,945 | 8/1926 | Kaplon | 116/70 |
| 1,895,394 | 1/1933 | Morrison | 116/70 |
| 2,417,480 | 3/1947 | Friedman | 46/179 |
| 2,505,141 | 4/1950 | Pitts | 84/330 |
| 2,682,250 | 6/1954 | Ulrich | 116/137 R |
| 2,804,839 | 9/1957 | Hallinan | 116/137 R |
| 3,536,157 | 10/1970 | Ansley | 116/27 |
| 3,548,371 | 12/1970 | Alexander | 340/12 |
| 3,741,333 | 6/1973 | Muniz et al. | 116/137 |
| 3,903,988 | 9/1975 | Hermsen et al. | 116/137 |
| 4,047,592 | 9/1977 | Sieber et al. | 340/3 |
| 4,095,667 | 6/1978 | Mahig et al. | 181/120 |
| 4,185,670 | 1/1980 | Sartell | 116/2 |
| 4,252,076 | 2/1981 | Williams et al. | 116/137 |
| 4,462,483 | 7/1984 | Betts et al. | 116/37 |

*Primary Examiner*—William A. Cuchlinski, Jr.
*Assistant Examiner*—W. Morris Worth
*Attorney, Agent, or Firm*—Fulwider, Patton, Rieber, Lee & Utecht

[57] ABSTRACT

A resonant tube having an inlet fitting at one end for connection to the regulator hose attached to an intermediate pressure port on the first stage of a scuba diver's regulator and containing therein a sound generator responsive to pressurized air for generating an audible sound to be propagated against the wall of such tube. The outlet from such tube includes a normally closed air valve which may be selectively depressed to release air from such resonator tube causing incoming air to flow through such generator to generate such audible sound. Frequencies generated are propagated to the surrounding water or air.

4 Claims, 2 Drawing Sheets

FIG. 1
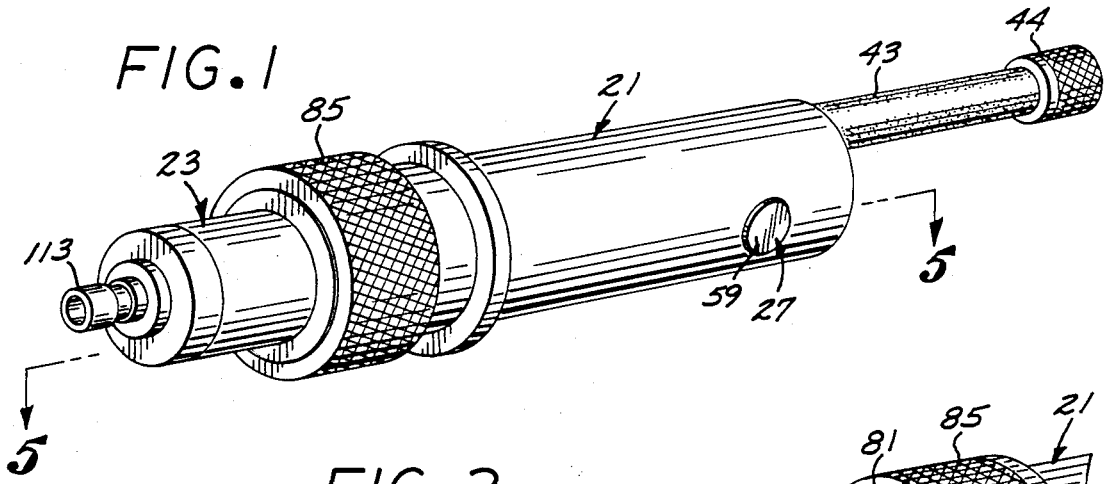
FIG. 2
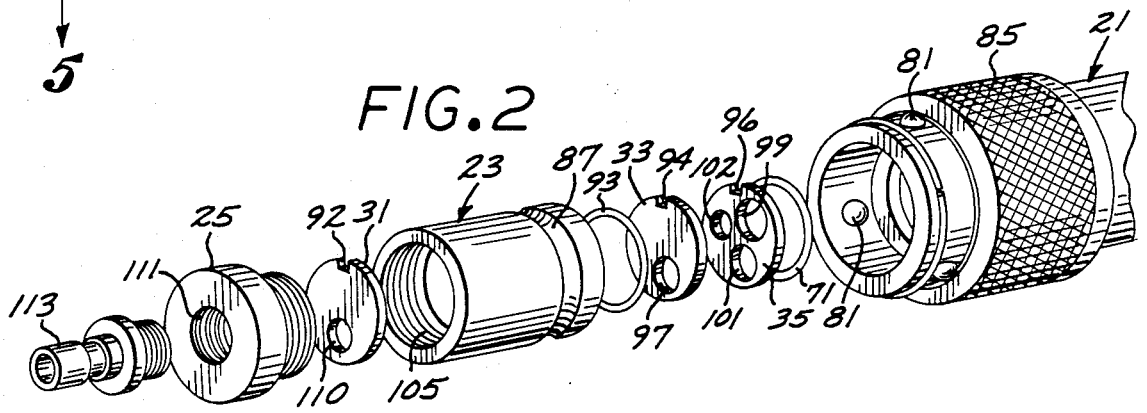
FIG. 3
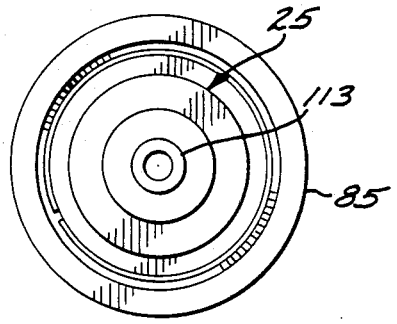
FIG. 4
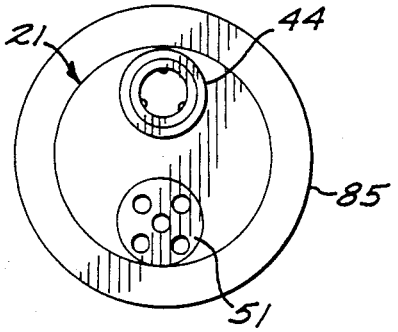
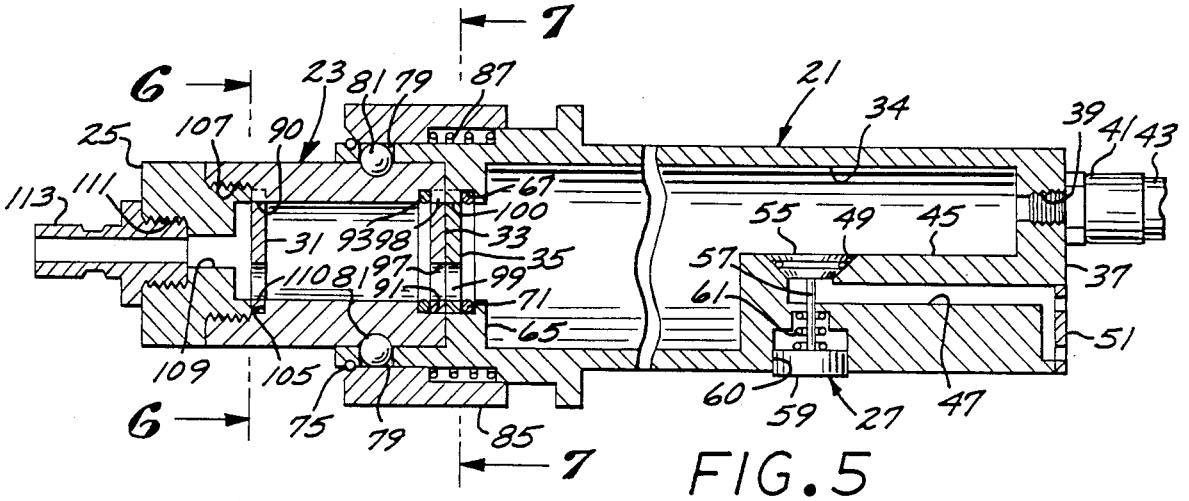
FIG. 5

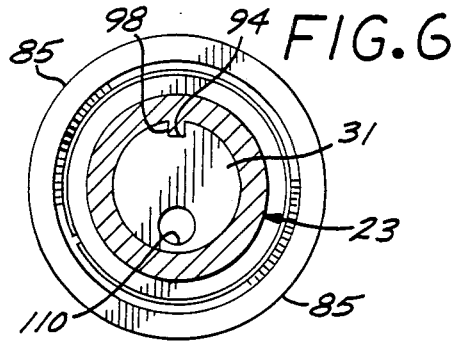
FIG. 6
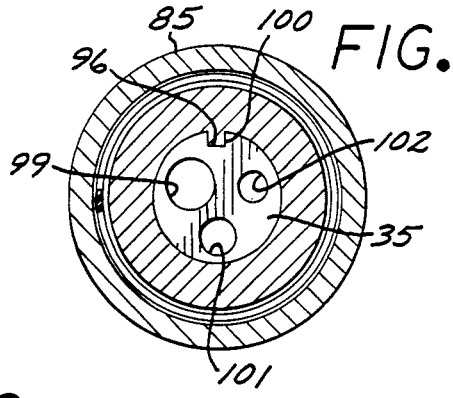
FIG. 7
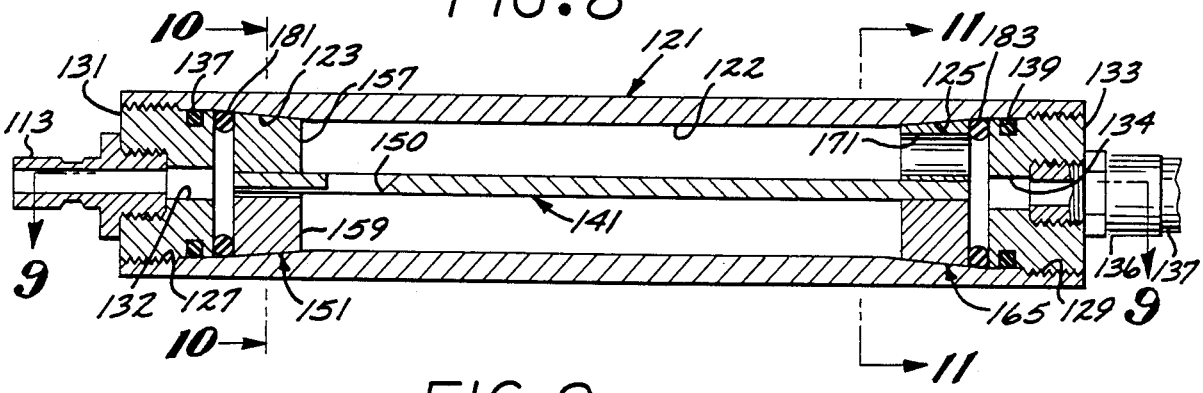
FIG. 8
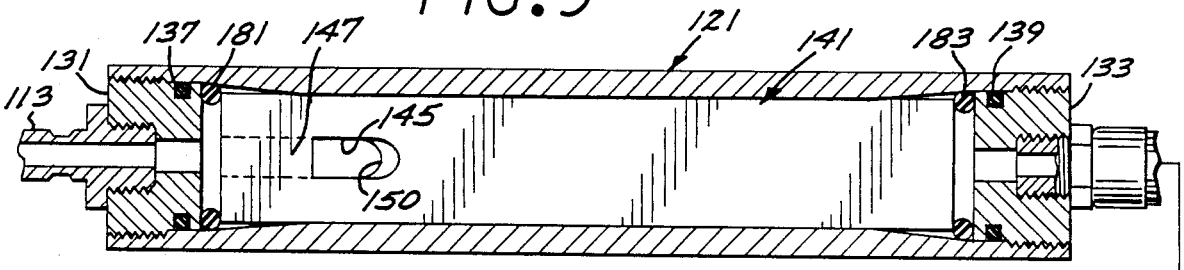
FIG. 9
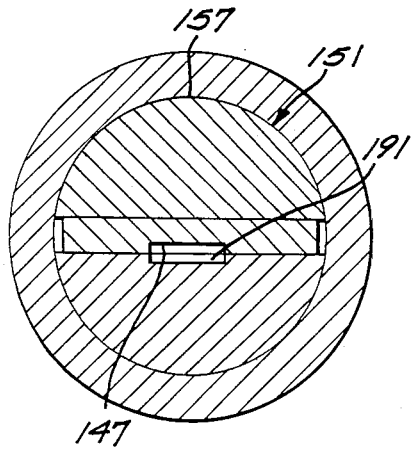
FIG. 10
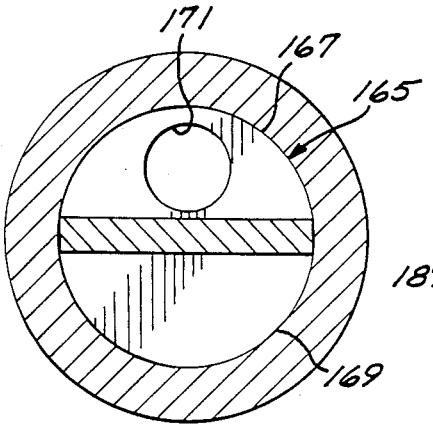
FIG. 11
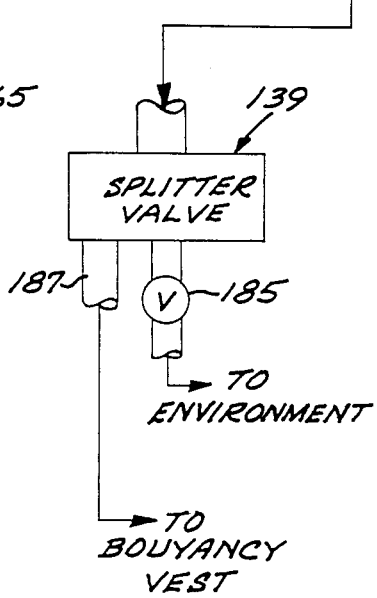

SCUBA WHISTLE

BACKGROUND OF THE INVENTION

1. Field of the Invention

The present invention relates to a pneumatic whistle, which can be used underwater or in an air medium, and is driven by pressure from a scuba diver's air tank.

2. Description of the Prior Art

Scuba (Self Contained Underwater Breathing Apparatus) diving has grown as a major sport and is also practiced for commercial, technical, scientific, and military purposes. The demand for safe and reliable scuba diving equipment has expanded tremendously in the past decade, leading to major advancements in the art.

A scuba diver's breathing apparatus typically incorporates a cylinder or tank of air carried on the scuba diver's back. The cylinder is usually pressurized with normal or atmospheric air in the range of 2250–3000 pounds per square inch (psi).

Attached to, and physically part of, every compressed air cylinder is a tank valve. The function of this valve is to permit air into or out of the cylinder through an on/off control knob.

Regulators are mounted by the diver to the tank valve. Most regulators have two stages. Each stage sequentially reduces the compressed air stored in the cylinder to levels sufficient for the diver to breathe.

The first stage of the regulator reduces air cylinder pressure from 2250–3000 psi to a constant intermediate pressure of 105–145 psi. Flexible rubber hoses, also called regulator hoses, convey this intermediate air to the second stage of the regulator. The second stage further reduces the intermediate air to breathable, or ambient, air pressure. The second stage is physically connected to the diver's mouthpiece through which breathable air is inhaled. Exhaled air is exhausted from the second stage directly into the water.

Intermediate air pressure ports on the first stage of the regulator may accommodate several regulator hoses. Each hose, however, has a constant intermediate pressure of 105–145 psi. In the example just described, the regulator hose was connected to the second stage, enabling the diver to breathe ambient air.

Purposes for which each regulator hose may be used are varied. Regulator hoses coming from the first stage may also be connected to the diver's buoyancy control device (BCD), which is an inflatable vest, jacket, or collar worn by the diver. Inflation of the BCD increases a diver's buoyancy and promotes ascent. Deflation of the BCD decreases buoyancy and promotes descent. Air for inflation of the BCD is supplied by the regulator hose connected to the first stage of the regulator.

Additionally, divers may use auxillary regulator hoses from intermediate pressure ports to power underwater tools—like chissels, hammers and drills.

In the past, underwater communication between scuba divers was principally limited to visual signals, such as hand signs or light signals. Unfortunately, hand signals are not clearly discernable at night, over great distances, or under low visibility water conditions. Similarly, underwater light signals are virtually undetectable during the day at any distance. Moreover, neither hand signs nor light signals are effective if the receiving diver is not directly viewing or is inattentive to the signaller. The inability to communicate clearly between scuba divers can have life threatening consequences.

The diving community desparately demands an economical, convenient, and reliable sound generator for safe and effective communication.

There exists a need for a sound generator to communicate: between submerged dive buddies or teams of divers; between scuba instructors and students; between submerged divers and divers or personnal at the surface; and between divers and other personnel at the surface. The need exists for this sound generator to have the capability of varying the frequency emitted in order to attract or repel marine life, as well as to enhance the effectiveness of communication between divers at various depths. In short, the diving community needs a variable sound generator which may be activated by air pressure of 105–145 psi typically found in regulator hoses attached to intermediate air pressure ports on the first stage of scuba diver's regulators.

Numerous acoustical energy generators have been developed for military purposes and which mount on underwater vehicles for marking purposes, decoy purposes, communication purposes, echo ranging purposes, and the like. However, such devices typically suffer shortcomings associated with high pressure devices, like hot combustion products and exhaust gases of rocket propulsion engines. Such devices are structurally complex, requiring numerous moving and complicated parts, rendering them generally expensive and unreliable for long and service free lives.

SUMMARY OF THE INVENTION

The pneumatic whistle of the present invention is characterized by an air tight resonating tube having an inlet plug attached to a regulator hose which is connected to an intermediate pressure port on the first stage of the regulator. There is an outlet valve on the opposite end of the resonating tube. Interposed between the inlet and outlet valve is a variable sound generator responsive to air pressures on the order of 105–145 psi being applied thereto, to generate air vibrations which propogate against the wall of the resonant chamber for propogation through the surrounding water or air.

Other objects, features and variations of the invention will be evident from consideration of the following description taken in connection with the accompanying drawing.

BRIEF DESCRIPTION OF THE DRAWINGS

FIG. 1 is a perspective view of an underwater sound generator embodying the present invention;

FIG. 2 is an exploded view of the underwater sound generator shown in FIG. 1;

FIG. 3 is a left hand end view, in enlarged scale, of the underwater sound generator shown in FIG. 1;

FIG. 4 is a right hand view, in enlarged scale, of the underwater sound generator shown in FIG. 1;

FIG. 5 is a longitudinal broken, sectional view, in enlarged scale, taken along the line 5—5 of FIG. 1;

FIG. 6 is a transverse sectional view taken along the line 6—6 of FIG. 5;

FIG. 7 is a transverse sectional view taken along the line 7—7 of FIG. 5;

FIG. 8 is a longitudinal sectional view similar to FIG. 5 but of a second embodiment of the underwater sound generator of the present invention;

FIG. 9 is a longitudinal sectional view taken along the line 9—9 of FIG. 8;

FIG. 10 is a transverse sectional view, in enlarged scale, taken along the line 10—10 of FIG. 8; and FIG. 11 is a transverse sectional view, in enlarged scale, taken along the line 11—11 of FIG. 8.

DESCRIPTION OF THE PREFERRED EMBODIMENT

Referring to FIGS. 1, 2, 4, and 5, applicant's air driven pneumatic whistle includes, generally, a resonant housing 21 coupled with an inlet tube 23. Air is introduced to the inlet tube 23 through an inlet plug 25 which connects to the air hose leading from the first stage of a scuba diver's regulator. Flow from the resonator tube 21 is controlled by an outlet valve, generally designated 27. Interposed between the inlet fitting 25 and valve 27 is a sound generator, including an inlet orifice disk 31, sound generation disk 33 and tone disk 35. Consequently, air from the scuba diver's regulator hose maintains the resonant tube 21 pressurized and, upon actuation of the control valve 27, air will vent therefrom causing a pressure drop across the sound generation disk 33, thus introducing bird tone vibrations which are propogated throughout the tube 21 to the walls thereof to thus vibrate such walls to thereby propogate the resultant noise through the surrounding water or air to nearby divers.

Referring to FIGS. 1, 2 and 5, the tubes 21 and 23 may be constructed of any desirable material which will resist the corrosive environment of sea water and which will respond to vibrations generated by air escaping through the orifice of the disk 33 and propogated through the air in such tube to be transmitted through the walls thereof to the surrounding water or air for propogation therethrough. I have discovered thin walled stainless steel tubing having a diameter of about 1¼ inches and a wall thickness of about 1/16 of an inch serves the function of acting as an ideal resonant tube 21. The resonant tube 21 forms a resonant chamber 34 which is preferably about six inches in length and is formed on one end with an end wall 37 having formed therein a threaded outlet port 39. Screwed into the threaded outlet port is a nipple 41 connected with the end of an air hose 43 which may be, for instance, connected to a buoyancy compensating device (BCD) or, threaded outlet port 39 may be plugged, creating a terminal device attached by nipple 113 to an auxillary regulator hose connected to intermediate pressure port in the first stage of the diver's regulator.

Referring to FIG. 5, formed within the chamber 34 is an interior boss defining a valve housing 45 which is formed with a vent passage 47 leading from a valve seat 49 to an outlet screen 51. A conical valve poppet 55 seats on the valve seat 49 and has an axial stem 57 projecting therefrom and connected on its opposite end with a thumb plate 59 received in an exterior bore 60. The thumb plate is biased outwardly away from the seat 49 by means of a coil spring 61 such that the poppet is normally closed on such seat.

The end of the resonant tube 21 adjacent the inlet tube 23 includes an interior flange 65 formed with an axially outwardly opening gland 67 for receipt of the toning disk 35. Interposed between such toning disk and the bottom of the gland 67 is a sealing O-ring 71. The resonant tube 21 is formed beyond the flange 65 with a barrel 75 which is telescopically received over the joining end of the inlet tube 23. The barrel 75 is formed with conically shaped, radially extending bores 79 which slidably receive locking balls 81 for limited radial movement therein. Telescoped over the barrel 75 is a locking sleeve 85 which is biased to its extended locking position shown in FIG. 5 by means of a coil compression spring 87.

The inlet tube 23 is formed externally with a locking groove 87 which is adapted to receive the radially interior peripheries of the locking balls 81 as shown in FIG. 5.

The end of the inlet tube 23 abutting the resonant tube flange 65 is formed with a axially outwardly opening gland 91 for receipt of the sound generating disk 33, an O-ring 93 being interposed between such disk and the bottom of the gland itself. In the assembled position, the disk 33 and 35 are maintained in abutment against one another. The sound generating disk 33 includes an orifice 97 which is arranged to be disposed in confronting relationship with a selected ones of the orifices 99, 101 and 102 in the tone disk 35 (FIG. 2).

The inlet end of the tube 23 is also formed with an axially outwardly opening gland 105 for receipt of the inlet disk 31, the tube itself being counterbored and threaded to form interior threads 107 for mating with the external threads on the end fitting or plug 25. The inlet plug 25 is formed with a through bore 109 leading to a threaded counterbore 111 into which a nipple 113 is screwed. The nipple 113 connects with the regulator hose (not shown) from the first stage of the scuba diver's regulator.

Referring to FIGS. 2 and 5, it will be appreciated that the disks 33 and 35 are formed in their peripheries with respective radially outwardly opening registration notches 94 and 96 which register with respective axial splines 98 and 100 formed in their respective glands 91 and 67 such that when the resonator tube 21 is rotated relative to the inlet 23, the tuning disk 35 will be rotated relative to the sound generating disk 33 to thus vary registration between the orifice 97 and the orifices 99, 101 and 102 to thus vary the frequency of the sound generated. Similarly, the inlet disk 31 is formed with a radially outwardly opening notch 92 which is slidably received on an axial spline formed in the gland 105 (FIG. 5).

It will be appreciated by those skilled in the art that any one of the disks 31, 33 or 35 will serve to generate the desired bird tone vibrations. However, as will be described hereinafter, with the combination shown, the flow of the high pressure air is most efficiently directed at the orifice 97 of the sound disk 33 and tuned by the turning disk 35.

In operation, it will be appreciated that the nipple 113 is connected with an air hose leading from the first stage of the regulator attached to the scuba diver's cylinder tank. Typically, the first stage regulator regulates the air down to a pressure of about 105–145 psi. Consequently, the air supplied to the interior of the inlet tube 23 and resonant tube 21 will be at about 105–145 psi. The whistle will remain tethered from such air hose and, may, if desirable, be connected with an auxiliary air hose by means of the quick disconnect 44. For instance, the hose leading to a buoyancy compensation device (not shown) may be connected with the connector 44 (FIG. 1) such that air will be supplied through the resonant tube 21 to such buoyancy inflator for inflation thereof.

When the scuba diver descends the sound generator will remain tethered for convenient access should the diver want to utilize same to emit signals therefrom. The whistle may be actuated by the diver grasping it in his hand and depressing the thumb button 59 of the control valve 27 to raise the poppet 59 off the seat 49

(FIG. 5). The 105–145 psi pressure air in the resonant chamber 34 will then be permitted to vent between such poppet and seat to be vented out the vent passage 47 and screen 51 into the surrounding water.

The orifices 97 and 99 may have a diameter of about ¼ inch for good sound generation and tone. It will be appreciated that the pressure drop across the disks 33 and 35 produces high velocity flow through the orifices 97 and 99 thereby generating vibration on the downstream side of the disk 35, which vibration will be propogated through the air in the resonant chamber 34 to the wall of such chamber for vibrating such wall and propogation into the surrounding water or air. It is appreciated that sound wave propogation from the orifice 99 will be relatively symetrical within the chamber thus providing for multidirectional uniform propogation from the resonance tube 21. Such sound waves generated in the tube will be propogated through the surrounding water or air and to nearby divers or marine life in the vicinity. With the tone adjustment disk 35 adjusted for generation of sound waves proving the most efficient for propogation at the particular depth at which the subject pneumatic sound generator is to be used, such sound waves will be propogated to nearby divers thus alerting them of the desire for communication. If desirable, the resonant tube 21 may be rotated relative to the inlet tube 23 to thus adjust registration of the orifice 99 relative to the orifice 97 to thus vary the frequency in a selected manner. If desirable, a predetermined code may be developed by varying such frequencies or by emitting the same frequency a certain number of times in a predetermined manner, thus communicating intelligently to the nearby divers.

For other applications, such as attraction or repulsion of marine life, the frequency generated may be further varied by further adjusting registration of the orifices 99, 101 and 102 relative to the orifice 97 to produce more or less pressure drop across the disk 35 to achieve the desired frequency for repulsion or attraction of such marine life as the case may be.

Referring to the second embodiment of the sound generator of the present invention as shown in FIGS. 8–11. Such generator includes a resonant tube, generally designated 121 formed with a resonant chamber 122. The tube is formed interiorly on its opposite ends with interior funnel-shaped bearing surfaces 123 and 125 which have, at the axial outer extremities thereof, internally threaded inlet and outlet sections 127 and 129, respectively. Plug-like inlet and outlet fittings 131 and 133, respectively, are externally threaded for mating with such inlet and outlet threads to close off the ends of the tube 121. The plugs 131 and 133 include respective axial inlet and outlet bores 132 and 134 and are formed in their respective peripheries with respective O-ring grooves 137 and 139 which receive O-rings for hermatically sealing against the interior wall of such tube. A metallic reed, generally designated 141, divides the chamber 122 longitudinally. Such reed is formed adjacent the inlet end of the tube 121 with a downwardly opening slot 147 leading to a conventional elongated sound generating orifice 145 (FIG. 9) formed at its downstream end with an air splitting edge 150.

Referring to FIGS. 8 and 10, a conically shaped split inlet plug, generally designated 151, is received telescopically in the inlet end of the tube 121 and has its opposed conical surfaces abutted against the conical bearing surface 123. The split plug 151 is constructed of two symetrical plug halves 157 and 159 (FIGS. 8 and 10) having the inlet extremity of the reed sandwiched therebetween. The lower plug half 159 is formed with an upwardly opening groove 191 which confronts the slot 147 and cooperates therewith to form an inlet air passage from the inlet bore 132 to the orifice 145.

A conically shaped outlet plug, generally designated 165, is received in the outlet end of the tube 121 and has its exterior conical surfaces abutted against the bearing surface 125 (FIG. 8). The plug 165 is made up of upper and lower halves 167 and 169 between which the outlet extremity of the reed 141 is sandwiched. The upper plug half 167 is formed with a vent orifice 171 which communicates with the outlet bore 134 formed in the outlet plug 133.

Interposed between the respective inlet fitting 131, inlet plug 151 and outlet fitting 133 and outlet plug 165 are respective O-rings 181 and 183. Such O-rings serve, when the respective fittings 131 and 133 are screwed into position, to push the respective split plugs 151 and 165 firmly axially, inwardly, to wedge the respective plug halves 157 and 159 and 167 and 169 firmly against the opposite sides of the extremities of the reed 141 to hold such reed trapped in position.

The outlet connector 136 is connected with a tube 137 which leads to a splitter valve, generally designated 139, which is operative to direct air either to a vent valve 185 or to a hose 187 leading to a buoyancy compensating device (BCD). In practice, the splitter valve may be comparable to the valve 27 shown in FIG. 5.

In operation, the sound generator shown in FIGS. 8–11 operate similar to that for the generator shown in FIG. 5. In this regard, the nipple 113 may be connected with an air hose leading from the first stage of the scuba diver's regulator, which is mounted to the compressed air cylinder (or air tank). Air applied through such hose will pressurize the resonant chamber 122 thus maintaining it under pressure at all times. When the diver desires to generate a sound for signalling other divers or repelling or attracting marine life, the valve 185 may be opened to thus vent air from the top side of the reed 141 (FIG. 8). Thus, air entering through the nipple 113 will be directed through the air passage 147 (FIGS. 8–9) at a velocity dictated by the pressure drop along such passage and across the orifice 145. The incoming air stream will strike the air splitting edge 150 thus generating sound waves which will be propogated in the chamber 122 and against the walls of the tube 121 to be communicated therethrough and to the surrounding water or air. Air continuing on through the orifice 145 will pass longitudinally through the chamber 122, through the outlet bore 171 in the plug half 167 and out the exhaust bore 134 and finally out the valve 185 to the environment. It will be appreciated that the size and configuration of the reed 141 may be changed or altered to adjust the tone propogated thereby for various different applications.

From the foregoing it will be apparent that the pneumatic sound generator of the present invention affords a practical and convenient means for communicating under water. The generator is driven by readily available 105–145 psi air and is compact and durable thus affording a long and trouble free life.

Various modifications and changes may be made with regard to the foregoing detailed description without departing from the spirit of the invention.

I claim:

1. An underwater whistle for coupling with a regulator hose leading from a scuba diver's regulator mounted on a scuba diver's compressed air cylinder to supply air at a predetermined pressure, said whistle comprising:

elongated housing means including elongated inlet and resonant tubes disposed in end to end relationship, said inlet tube having an upstream and downstream end, said resonant tube having an inlet end, said inlet tube being formed with internal threads at one end to define said upstream end and abutting on its downstream end with the inlet end of said resonant tube, and being formed internally with a gland;

an inlet cap in said upstream end and including coupling means for coupling with such regulator hose;

a control valve for controlling air flow from an outlet end of said resonant tube;

a stationary air actuated sound generator mounted in said housing means interposed between said inlet cap and control valve positioned for direct flow of air therethrough, said sound generator being responsive when said whistle is disposed underwater, to air flow from said inlet cap at said predetermined pressure, to generate an audible sound vibration within said resonant tube, said sound generator includes a sound disc disposed on said gland and formed with an orifice responsive to air flowing therethrough to generate said audible sound vibration; and joining means for joining said inlet and resonant tubes together, whereby said coupling means may be coupled with said hose and a diver wearing said compressed air cylinder, while underwater, may open said control valve to communicate air from such diver's compressed air cylinder through said hose to said sound generator to generate said audible sound vibration to be propogated through such water.

2. An underwater whistle according to claim 1 wherein:

said resonant tube is formed at said inlet end with a disc receiving gland;

said sound generator includes a tone disc in said disc receiving gland of said resonant tube and wherein:

said inlet cap having an inward end and an outward end, said inward end formed with exterior threads for screwing into said internal threads of said inlet tube.

3. An underwater whistle according to claim 1 wherein:

said inlet end of said reasonant tube is formed with a disk receiving gland;

said sound generator includes a tone disk received in said disk receiving gland, of said resonant tube and formed with a plurality of bores of different diameters and said disks being rotatable relative to one another such that said bores may be selectively aligned with said orifice.

4. An underwater whistle according to claim 1 wherein:

said joining means includes an exterior groove formed on said inlet tube and a skirt formed with said resonant tube for telescopical receipt over the downstream end of said inlet tube and said skirt formed with radial bores receiving ball locks for radial shifting therein for selective engagement in said groove, said joining means further including a locking sleeve telescopically received on said resonant tube for selective positioning over said balls to hold them registered in said groove.

* * * * *